US009072927B2

(12) United States Patent
Sammann

(10) Patent No.: US 9,072,927 B2
(45) Date of Patent: Jul. 7, 2015

(54) FLOORING AND SHIPPING APPARATUS AND METHOD OF USE

(71) Applicant: Charles Sammann, Amarillo, TX (US)

(72) Inventor: Charles Sammann, Amarillo, TX (US)

(73) Assignee: Backyard Playsets of West Texas, Amarillo, TX (US)

( * ) Notice: Subject to any disclaimer, the term of this patent is extended or adjusted under 35 U.S.C. 154(b) by 45 days.

(21) Appl. No.: 13/744,505

(22) Filed: Jan. 18, 2013

(65) Prior Publication Data

US 2014/0206466 A1 Jul. 24, 2014

(51) Int. Cl.

| | |
|---|---|
| ***A63G 21/18*** | (2006.01) |
| ***E02D 27/00*** | (2006.01) |
| *A63B 17/00* | (2006.01) |

(52) U.S. Cl.

CPC ..... *A63B 17/00* (2013.01); *E02D 27/00* (2013.01)

(58) Field of Classification Search

CPC ..... A63G 21/00; A63G 21/18; A63G 31/007; A63B 9/00; A63B 17/00; A63B 2009/006; A63B 2009/002; A63B 2208/12

USPC ..... 472/116, 117, 136; 482/35, 36; 52/79.1–79.4

See application file for complete search history.

(56) References Cited

U.S. PATENT DOCUMENTS

| | | | | |
|---|---|---|---|---|
| 4,633,626 | A * | 1/1987 | Freeman et al. | 52/71 |
| 4,914,874 | A * | 4/1990 | Graham, Jr. | 52/79.1 |
| 4,967,520 | A | 11/1990 | Post, Jr. | |
| 7,543,411 | B2 * | 6/2009 | Whitehead et al. | 52/66 |
| 2004/0002394 | A1 * | 1/2004 | Heipp et al. | 472/136 |

* cited by examiner

*Primary Examiner* — Kien Nguyen
(74) *Attorney, Agent, or Firm* — Shannon L Warren

(57) ABSTRACT

A outdoor structure flooring apparatus is disclosed comprising: a flooring having a one or more sockets, a length and a width. Said one or more sockets receiving a portion of a one or more legs of an outdoor structure. Said flooring comprises a shipping pallet for said outdoor structure.

19 Claims, 18 Drawing Sheets

FLOORING AND SHIPPING APPARATUS AND METHOD OF USE

BACKGROUND

This disclosure relates generally to a flooring and shipping apparatus and method of use. One example of an outdoor structure flooring system can be found in U.S. Pat. No. 4,967,520. However, none of the known inventions and patents in the art, taken either singularly or in combination, is seen to describe the instant disclosure as claimed. Accordingly, an improved flooring and shipping apparatus and method of use would be advantageous.

SUMMARY

A first outdoor structure flooring apparatus, a second outdoor structure flooring apparatus, an outdoor structure installation method, and a third outdoor structure flooring apparatus are disclosed.

Said first outdoor structure flooring comprising: a flooring having a one or more sockets, a length and a width. Said one or more sockets receiving a portion of a one or more legs of an outdoor structure. Said flooring comprises a shipping pallet for said outdoor structure. Said one or more sockets and said one or more legs comprise of 6 of each. Said one or more sockets and said one or more legs are arranged around a perimeter of said flooring. Said one or more sockets comprise a top portion and a bottom portion. Said one or more sockets taper from said top portion to said bottom portion. Said outdoor structure comprises a one or more components. Said flooring and said outdoor structure comprises a packaged configuration and an assembled configuration. Said assembled configuration comprises said one or more components of said outdoor structure assembled for use. Said packaged configuration comprises said one or more components of said outdoor structure packaged for shipping. Said outdoor structure can comprise a play set. Said one or more components comprise a slide. Said packaged configuration of said outdoor structure can comprise said slide detached from said side portion of said outdoor structure and stored within a portion of said outdoor structure. Said flooring comprises a shipping pallet for said outdoor structure in said packaged configuration. Said assembled configuration comprises said slide attached to a side portion of said outdoor structure. and Said flooring comprise a flooring for said outdoor structure in said assembled configuration.

Said second outdoor structure flooring apparatus comprising: a flooring having a one or more sockets, a length and a width. Said one or more sockets receiving a portion of a one or more legs of an outdoor structure. Said flooring comprises a shipping pallet for said outdoor structure.

Said outdoor structure installation method comprising: assembling a one or more legs of an outdoor structure to a one or more sockets of an flooring; packing said flooring and said outdoor structure into a packaged configuration; shipping said packaged configuration to a destination; placing said outdoor structure and said flooring at said destination; and unpacking said packaged configuration to an assembled configuration.

Said third outdoor structure flooring apparatus comprising: a socketless flooring having a length and a width and a one or more brackets. Said socketless flooring comprising a platform and a one or more support beams. Said one or more brackets attach a one or more legs of an outdoor structure to said platform. Said flooring comprises a shipping pallet for said outdoor structure. Said outdoor structure comprises a one or more components. Said socketless flooring and said outdoor structure comprises a packaged configuration and an assembled configuration. Said assembled configuration comprises said one or more components of said outdoor structure assembled for use. Said packaged configuration comprises said one or more components of said outdoor structure packaged for shipping. Said packaged configuration of said outdoor structure can comprise said one or more components detached from said side portion of said outdoor structure and stored within a portion of said outdoor structure. Said flooring comprises a shipping pallet for said outdoor structure in said packaged configuration. Said assembled configuration comprises said one or more components attached to a portion of said outdoor structure. and Said flooring comprise a flooring for said outdoor structure in said assembled configuration. Said outdoor structure can comprise a play set. Said one or more components comprise a slide. Said packaged configuration of said outdoor structure can comprise said slide detached from said side portion of said outdoor structure and stored within a portion of said outdoor structure. and Said flooring comprises a shipping pallet for said outdoor structure in said packaged configuration.

DETAILED DESCRIPTION

Described herein is a flooring and shipping apparatus and method of use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
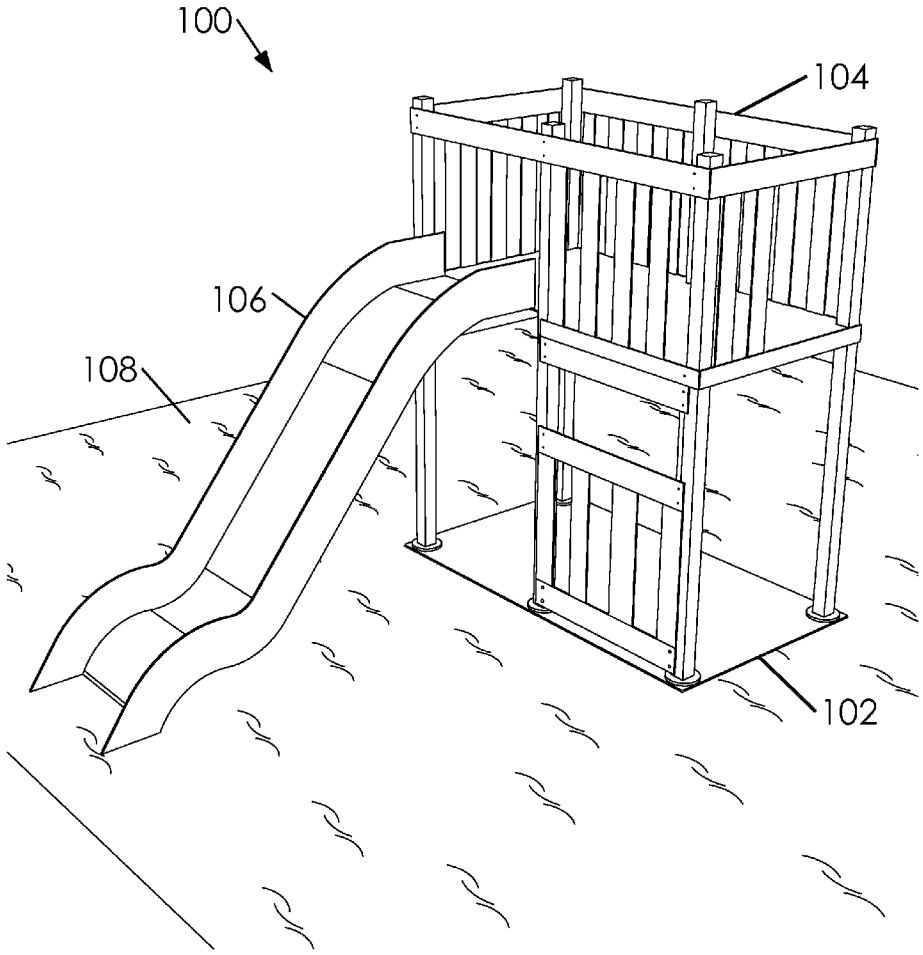
FIG. 1 illustrates an elevated front perspective view of an assembled outdoor structure.

FIG. 1 illustrates an elevated front perspective view of an assembled outdoor structure 100. In one embodiment, said assembled outdoor structure 100 can comprise of a flooring 102 and an outdoor structure 104. In one embodiment, said outdoor structure 104 can comprise a play set, a dog house, shed, green house, swing set, or other structure. In one embodiment, said assembled outdoor structure 100 can comprise a slide 106. In one embodiment, said outdoor structure 104 and said flooring 102 can be installed into a ground 108. In one embodiment, the manufacturing and shipping and installation of said outdoor structure 104 comprises building one or more component parts of said outdoor structure 104, packaging up said one or more component parts into a plurality of shipping containers, sending said plurality of containers to a customer and/or middle man, unpacking said one or more component parts, and building said outdoor structure 104 at the location of its use. In one embodiment, use of an improved procedure and manufacturing philosophy is advantageous to eliminate wasted time, shipping space, and resources. In one embodiment, use of said flooring 102 with said outdoor structure 104 can provide those advantageous qualities, as shown and described infra.

In one embodiment, said flooring 102 and said outdoor structure 104 are shipped in a condensed but mostly assembled state where said flooring 102 serves as a shipping pallet for said outdoor structure 104. In one embodiment, said flooring 102 can serve as a base for said outdoor structure 104 to provide a level surface for said outdoor structure 104 and to ensure a proper installation of said outdoor structure 104.

Figure 2A:
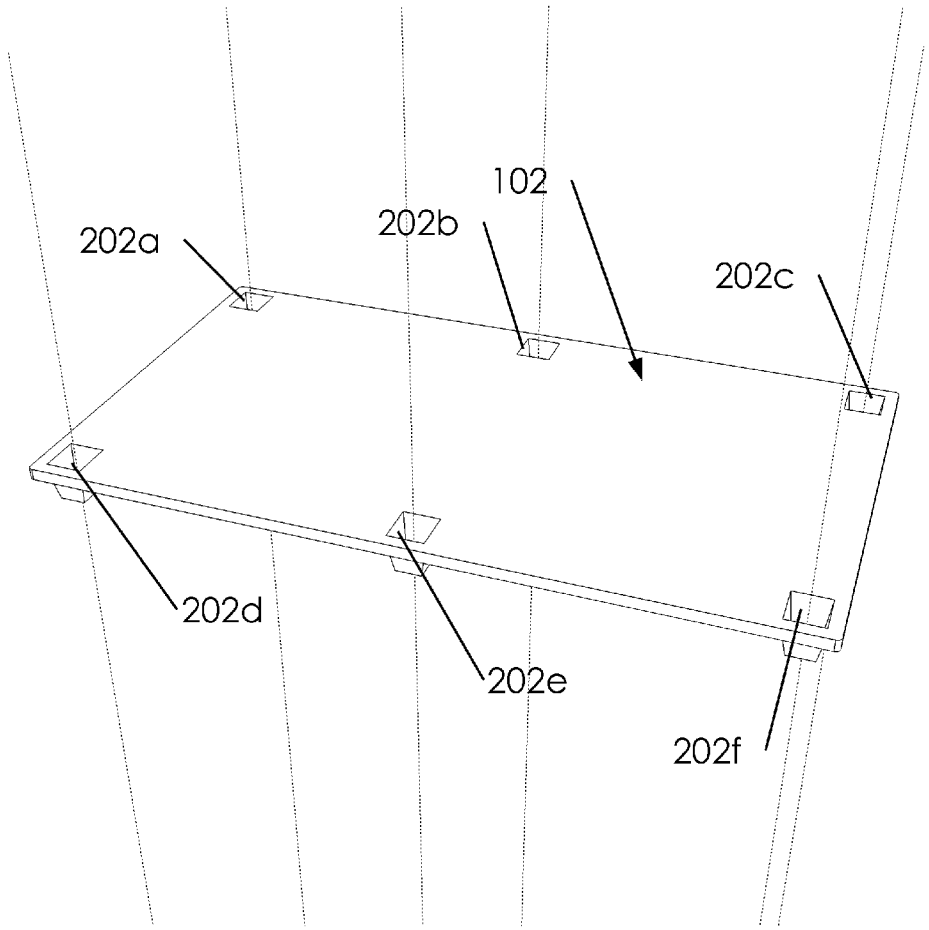
FIGS. 2A, 2B, and 2C illustrate a perspective overview, elevated top view, and front side view of said flooring respectively.
Figure 2B:
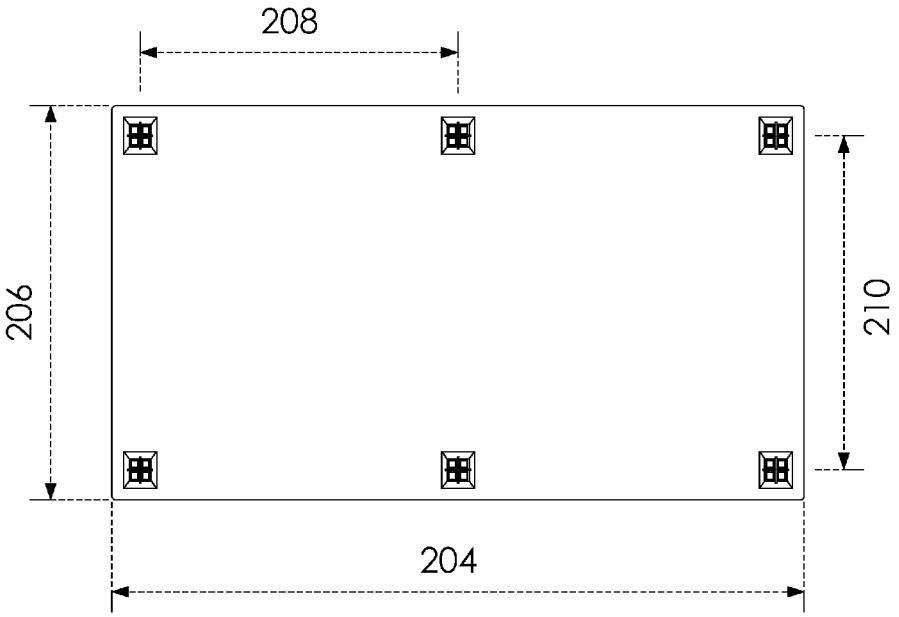
Figure 2C:
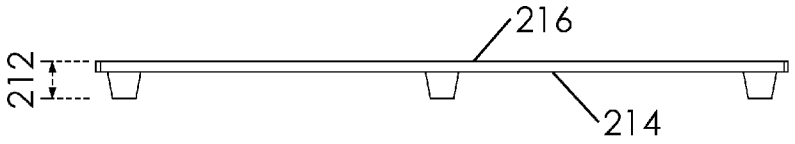

FIGS. 2A, 2B, and 2C illustrate a perspective overview, elevated top view, and front side view of said flooring 102 respectively. In one embodiment, said flooring 102 can comprise a one or more sockets. In one embodiment, said one or more sockets can comprise a first socket 202*a*, a second socket 202*b*, a third socket 202*c*, a fourth socket 202*d*, fifth socket 202*e*, and a sixth socket 202*f*. In one embodiment, said one or more sockets can have the same dimensions. In one embodiment, more or less sockets may be used for different versions of said outdoor structure 104. In one embodiment, said one or more sockets can be arranged in a perimeter around said flooring 102. In one embodiment, said flooring 102 can comprise a length 204 and a width 206. In one embodiment, said length 204 and said width 206 can be sized to fit on a gate lift. In one embodiment, using said length 204 and said width 206 permits ease of direct transport to residential properties. In one embodiment, said one or more sockets can be separated by a spacing 208 along said length 204. In one embodiment, said one or more sockets can be separated by a spacing 210 along said width 206. In one embodiment, said flooring 102 can comprise a height 212.

In one embodiment, said one or more sockets can be located at a four corners of said flooring 102. In another embodiment, said one or more sockets can comprise a socket in a central portion of said flooring 102; wherein, a weight (such as portion of said outdoor structure 104 can be used to hold down said socket in said central portion of said flooring 102 so as to prevent bowing up of said flooring 102.

In one embodiment, said flooring 102 can comprise a bottom surface 214 and a top surface 216.

Figure 3A:
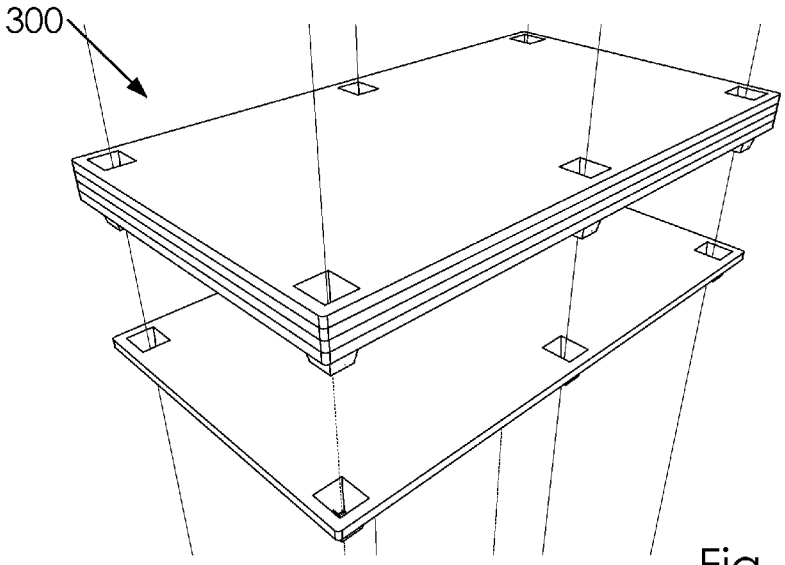
FIGS. 3A and 3B illustrate a perspective overview and an elevated section cut of a stacked flooring.
Figure 3B:
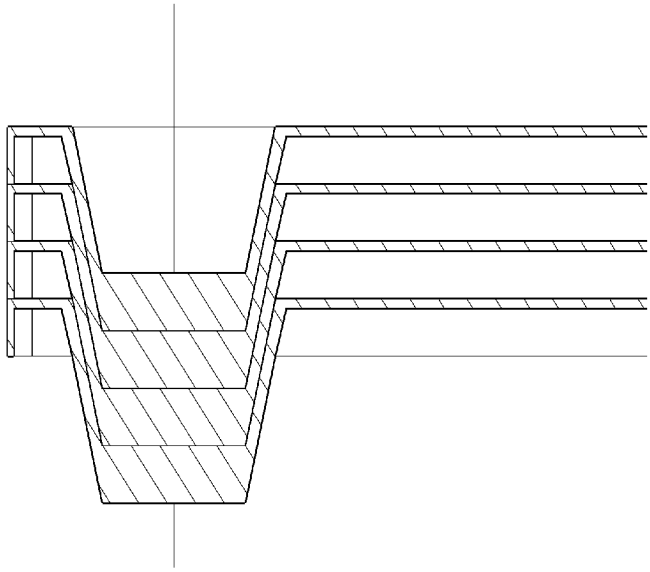

FIGS. 3A and 3B illustrate a perspective overview and an elevated section cut of a stacked flooring 300. In one embodiment, said stacked flooring 300 can be made by placing one or more of said flooring 102 on top of one another. In one embodiment, said flooring 102 can nest on top of each other thus permitting more efficient use of shipping and storage space. In one embodiment, said one or more sockets maintain a border 318 around said flooring 102.

In one embodiment, said stacked flooring 300 can comprise said length 204 and width 206. In one embodiment, said length 204 and said width 206 can fit into a standard shipping dimension. For example, in one embodiment, in North America said standard shipping dimensions can comprise 48" by 72" up to 48" by 96" inclusively. No universally accepted standards for pallet dimensions exist. Companies and organizations utilize hundreds of different pallet sizes around the globe. While no single dimensional standard governs pallet production, a few different sizes are widely used. Using standard size pallets can allow a shipping company to optimize a ratio of number of pallets per shipment. In one embodiment, said length 204 and said width 206 can match one or more of said standard shipping dimensions; therefore, said stacked flooring 300 can be shipped as a plurality of said flooring 102 to a location, and each of said flooring 102 can thereafter be used to ship said outdoor structure 104 by utilizing said flooring 102 as a pallet. Accordingly, said outdoor structure 104 can ship in an optimal form as its dimensions can be made to match those of said flooring 102 about its length and width.

FIGS. 4A, 4B, 4C and 4D illustrate an elevated top view, an elevated bottom view, an elevated side cross-section view and a perspective overview of one of said one or more sockets.

In one embodiment, said one or more sockets can comprise a top portion 402*a* and a bottom portion 402*b*. In one embodiment, said top portion 402*a* of said one or more sockets can have a first width 404*a* and a second width 404*b*. In one embodiment, said bottom portion 402*b* can comprise a first width 406*a* and a second width 406*b*. In one embodiment, said first width 404*a* and said second width 404*b* are larger than said first width 406*a* and said second width 406*b*. Thus, in one embodiment, said one or more sockets can comprise a trapezoidal shape suitable for stacking said one or more sockets.

Figure 4A:
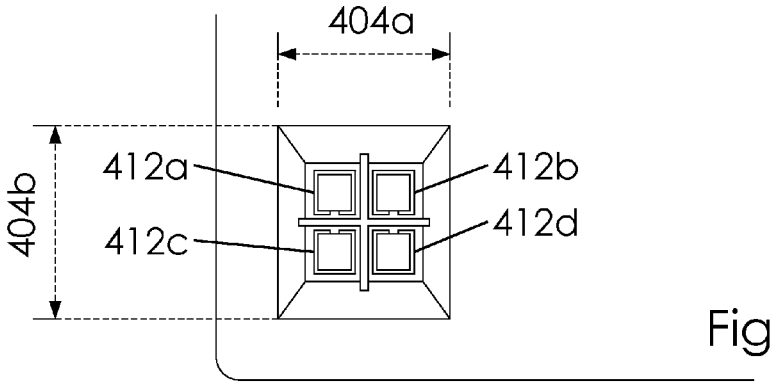
FIGS. 4A, 4B, 4C and 4D illustrate an elevated top view, an elevated bottom view, an elevated side cross-section view and a perspective overview of one of said one or more sockets.
Figure 4B:
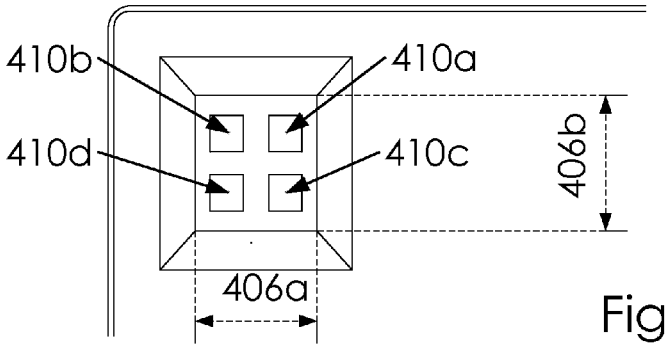
Figure 4C:
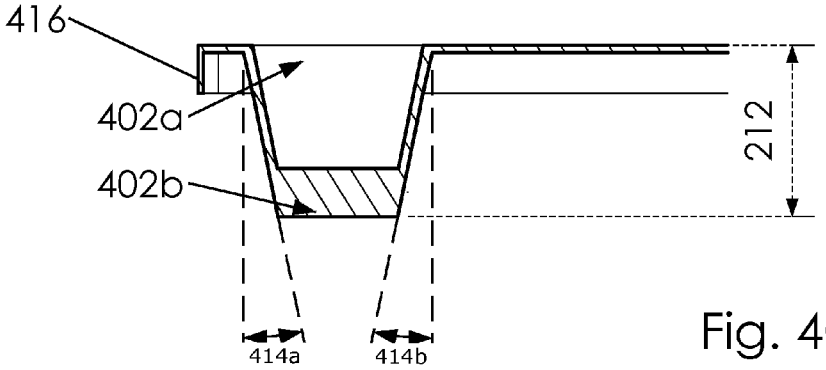
Figure 4D:
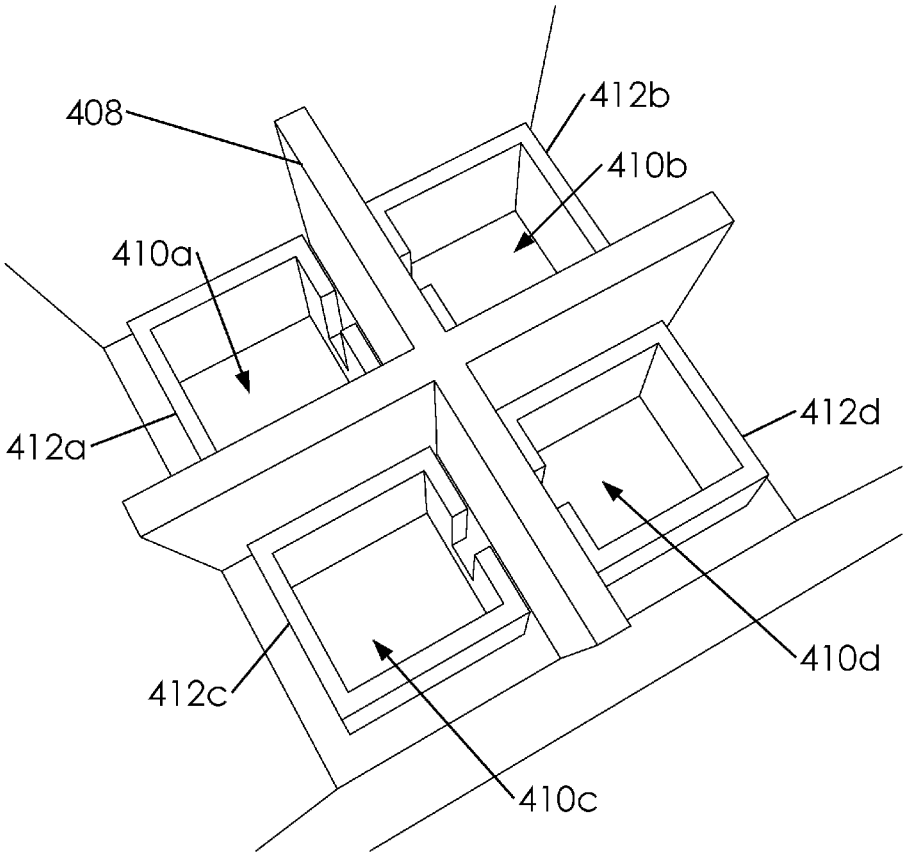

In one embodiment, said one or more sockets can have a stiffener assembly 408 to prevent warping and disfigurement. In one embodiment, said stiffener assembly 408 can separate said bottom portion 402*b* into a plurality of sections. For example, in one embodiment, said bottom portion 402*b* can be divided into four sections, as illustrated in FIG. 4D. In one embodiment, each of said sections can comprise a drain. In one embodiment, each of said drains can comprise a drain reinforcement. That is, in one embodiment, said one or more sockets can each comprise one or more drains. In one embodiment, said one or more drains can comprise of drain 410*a*, a drain 410*b*, a drain 410*c*, and a drain 410*d*. In one embodiment, more or less drains may be used. In one embodiment, said one or more drains permit moisture and fluids to escape from said one or more sockets on said flooring 102 during both storage and after installation. In one embodiment, said one or more drains can include one or more drain reinforcements. In one embodiment, said one or more drain reinforcements include drain reinforcement 412*a*, drain reinforcement 412*b*, drain reinforcement 412*c*, and drain reinforcement 412*d*. In one embodiment, said one or more drain reinforcements can be used to provide further reinforcement of said one or more sockets. In one embodiment, said one or more drain reinforcements can comprise a substantially "C" shape to permit water to escape more easily while maintaining structural integrity of said one or more sockets. In one embodiment, said one or more sockets can taper from top to bottom at an angle 414*a* and an angle 414*b*. In one embodiment, said flooring 102 can have a lip 416 on the perimeter of said flooring 102 that provides structural integrity for said flooring 102 during shipment and after installation.

Figure 5A:
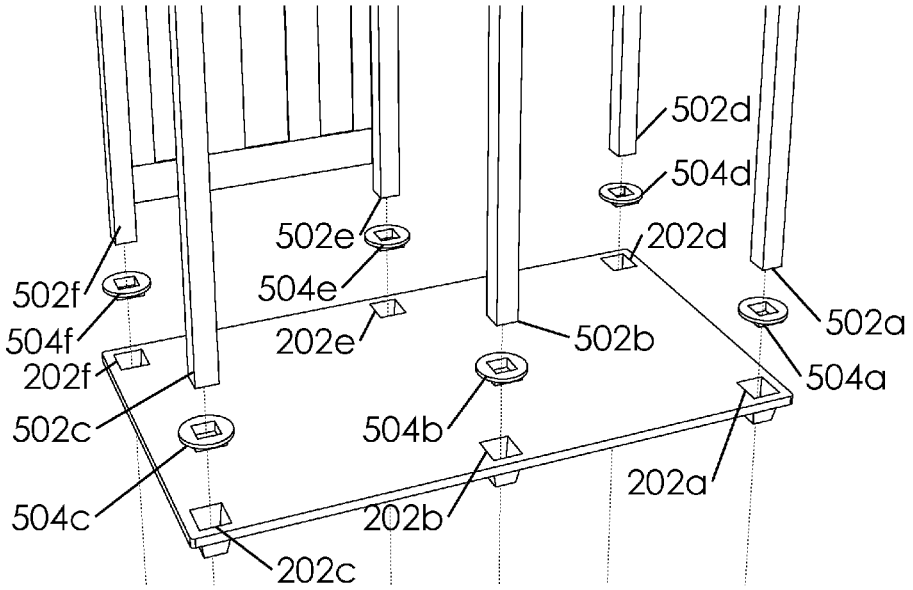
FIGS. 5A and 5B illustrate rear perspective overviews of said outdoor structure.
Figure 5B:
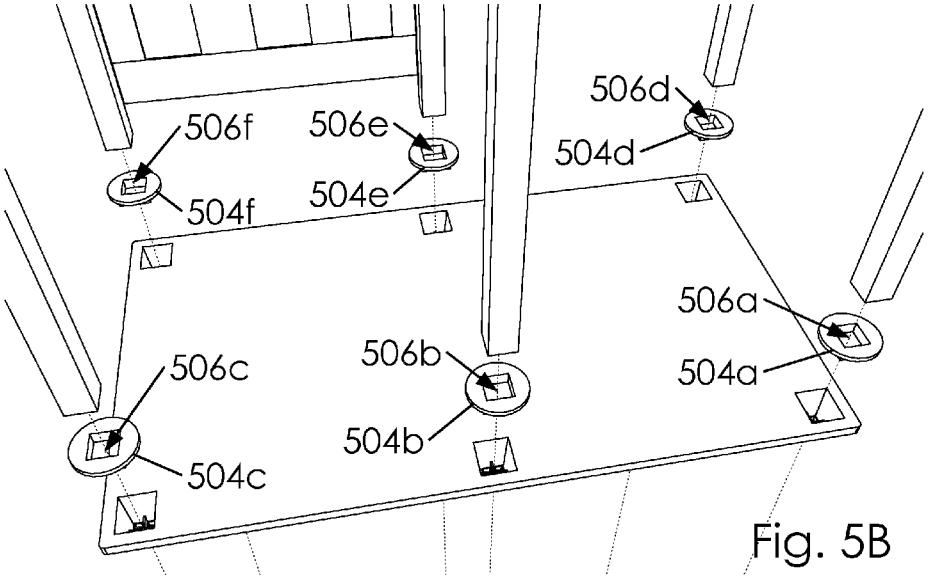

FIGS. 5A and 5B illustrate rear perspective overviews of said outdoor structure 104. In one embodiment, said outdoor structure 104 can comprise of one or more legs and a one or more caps. In one embodiment, said one or more legs can comprise a first leg 502*a*, a second leg 502*b*, a third leg 502*c*, a fourth leg 502*d*, a fifth leg 502*e*, and a sixth leg 502*f*. In one embodiment, said one or more legs can have the same dimensions. In one embodiment, said outdoor structure 104 can have more or less legs depending on a desired build or design. In one embodiment, said one or more caps can comprise a first cap 504*a*, a second cap 504*b*, a third cap 504*c*, a fourth cap 504*d*, a fifth cap 504*e* and a sixth cap 504*f*. In one embodiment, said one or more legs can attach to said flooring 102 by: aligning said one or more legs with said one or more caps and said one or more sockets; and inserting said one or more legs through a portion of said one or more caps and said one or more sockets. In one embodiment, said one or more caps can each comprise an aperture; for example, said first cap 504*a* can comprise an aperture 506*a*, said second cap 504*b* can comprise an aperture 506*b*, said third cap 504*c* can comprise an aperture 506*c*, said fourth cap 504*d* can comprise an aperture 506*d*, said fifth cap 504*e* can comprise an aperture 506*e* and said sixth cap 504*f* can comprise an aperture 506*f*.

Figure 6A:
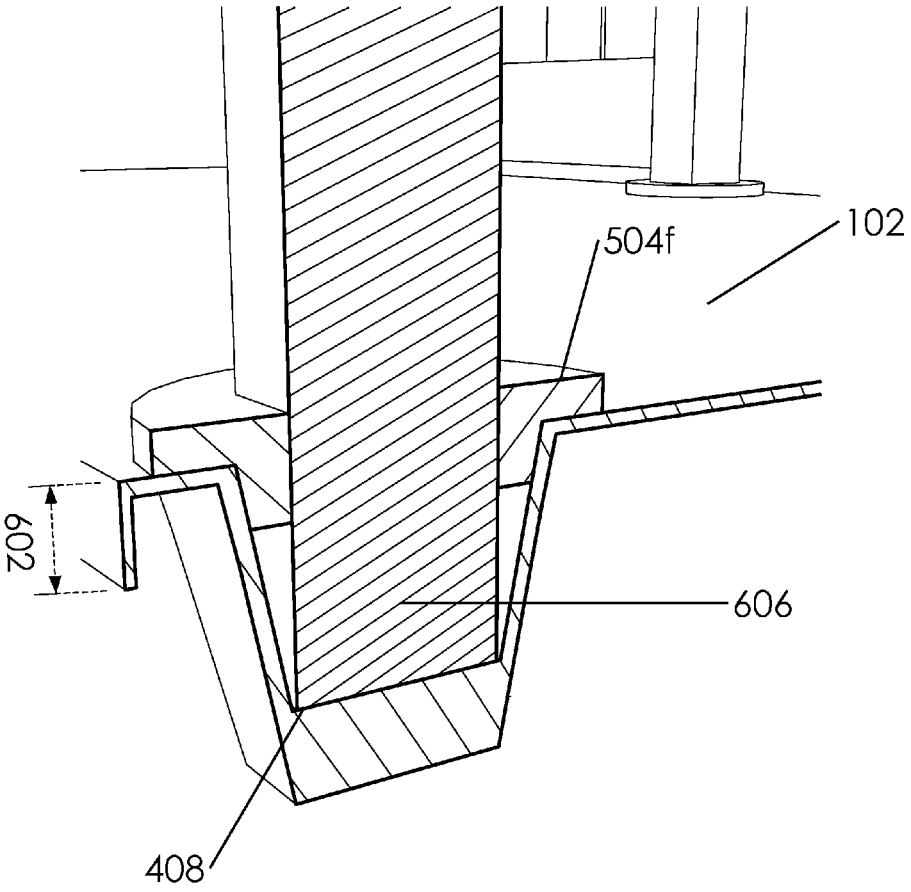
FIGS. 6A and 6B illustrate a cross-section perspective overview and a cross-section elevated view of said one or more legs installed in said one or more sockets.
Figure 6B:
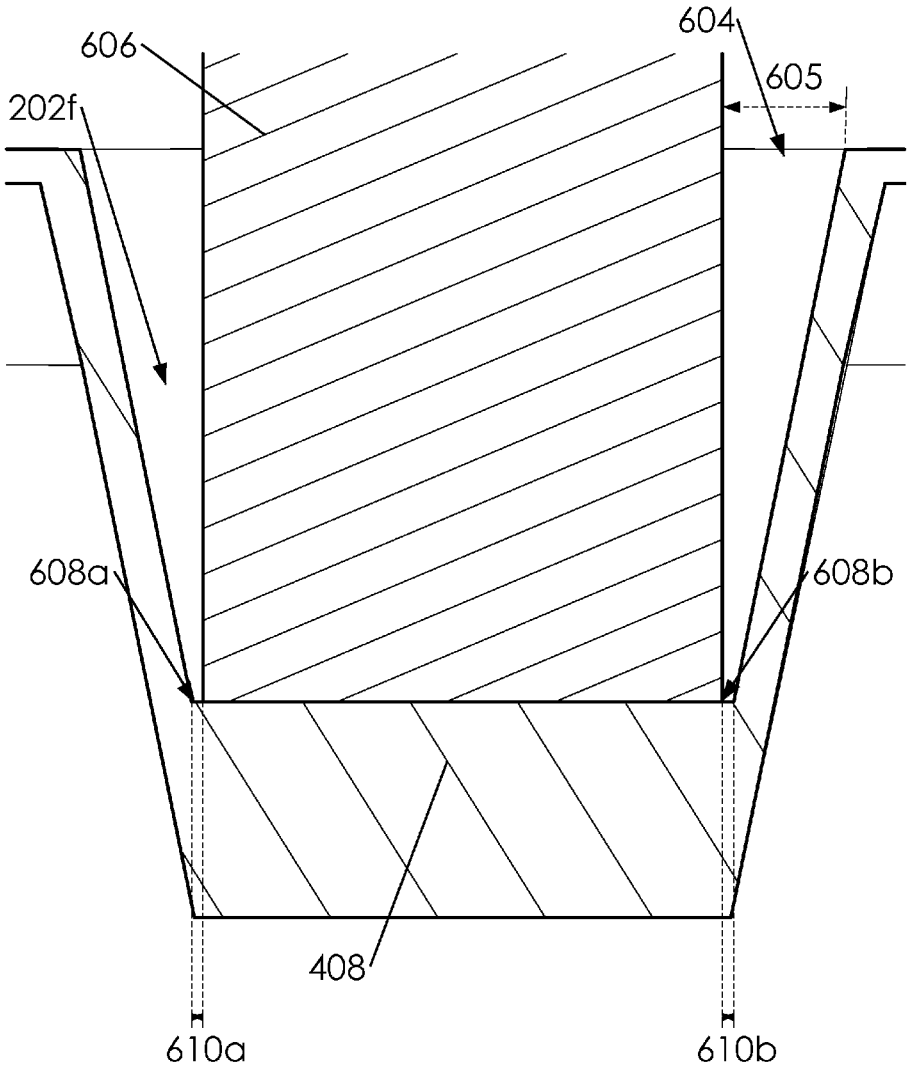

FIGS. 6A and 6B illustrate a cross-section perspective overview and a cross-section elevated view of said one or more legs installed in said one or more sockets. In one embodiment, said flooring 102 can be installed into said ground 108 at a depth 602. In one embodiment, said lip 416 can rest on said ground 108 and provide support and stability to said flooring 102 which thus provides support to said assembled outdoor structure 100. In one embodiment, a gap 604 having a width 605 is formed between said one or more legs and said one or more sockets when said one or more legs is installed into said one or more sockets. In one embodiment, lower leg portion 606 of said one or more legs can be inserted into said one or more sockets until said lower leg portion 606 is secured by the top of said stiffener assembly 408. In one embodiment, said gap 604 can be the same on all sides of said one or more sockets. In one embodiment, said width 605 of said gap 604 can comprise 1/32"-1/2". In one embodiment, other materials such as dirt or cement can be placed into said gap 604 to reinforce installation of said assembled outdoor structure 100. In one embodiment, said stiffener assembly 408 can maintain said one or more sockets shape while said one or more drains permit moisture and water to escape from said one or more sockets back into said ground 108. In one embodiment, a gap 608*a* and/or a gap 608*b* can be left between said lower leg portion 606 and said one or more sockets at said stiffener assembly 408. In one embodiment, a fluid can transfer from said one or more sockets around said lower leg portion 606 at said gap 608*a* and/or said gap 608*b* to said one or more drains. In one embodiment, said gap 608*a* can comprise a width 610*a* and said gap 608*b* can comprise a width 610*b*.

In one embodiment, said one or more caps can seal off a portion of said one or more sockets below said bottom surface 214 of said flooring 102. In one embodiment, said one or more caps can protect said one or more sockets from debris and/or moisture entering said one or more sockets. However, said one or more drains can drain debris and/or moisture from said one or more sockets, should the same ever penetrate said one or more caps. In another embodiment, said one or more caps can protect a user (such as a child) of said assembled outdoor structure 100 from injury from such causes as catching a hand or foot within said one or more sockets.

Figure 7A:
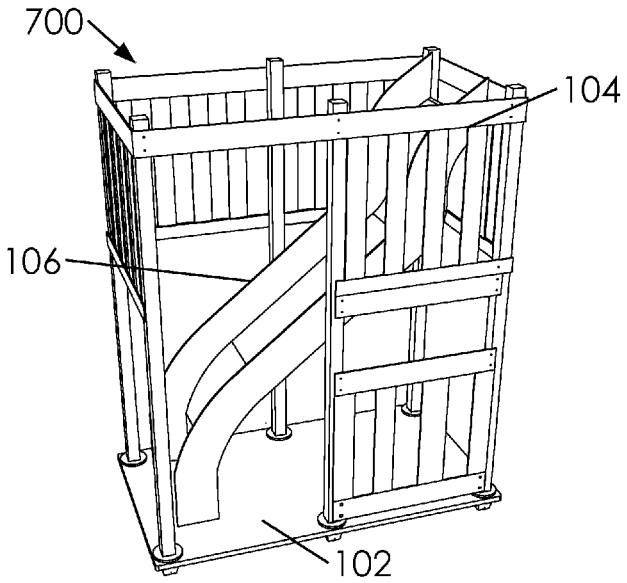
FIGS. 7A, 7B and 7C illustrate a perspective overview, an elevated front view and an elevated side view of a packaged play system.
Figure 7B:
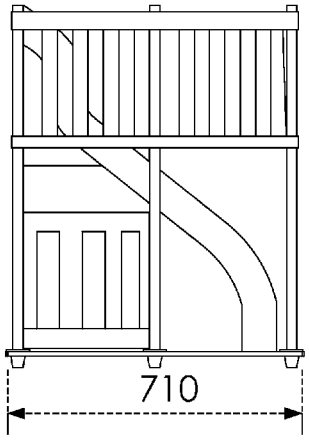
Figure 7C:
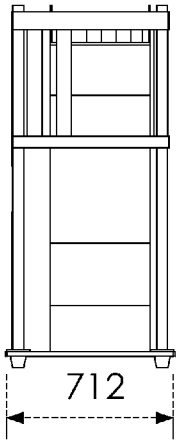

FIGS. 7A, 7B and 7C illustrate a perspective overview, an elevated front view and an elevated side view of a packaged play system 700. In one embodiment, said packaged play system 700 can comprise said assembled outdoor structure 100 in a shippable form. That is, said outdoor structure 104 and said flooring 102 can comprise an outdoor structure comprising an assembled configuration (said assembled outdoor structure 100) and a packaged configuration (said packaged play system 700). In one embodiment, said assembled configuration can comprise said assembled outdoor structure 100 with a one or more components assembled for use and said packaged play system 700 can comprise said one or more components packaged for shipping. In one embodiment, said assembled configuration can comprise said slide 106 attached to a side portion of said outdoor structure 104. In one embodiment, said one or more components can comprise said slide 106. In one embodiment, said assembled outdoor structure 100 and said packaged play system 700 can comprise said slide 106. In one embodiment, said packaged play system 700 can comprise said slide 106 rotated vertically to fit within said packaged play system 700 (as illustrated in FIG. 7A); and said assembled outdoor structure 100 can comprise said slide 106 rotated horizontally and attached to a side portion of said assembled outdoor structure 100 in order to accommodate children playing (as illustrated in FIG. 1). In one embodiment, said packaged play system 700 can comprise a length 710 and a width 712 equal to said length 204 and said width 206 of said flooring 102, respectively. Accordingly, by using said flooring 102 as a shipping pallet, said packaged play system 700 can comprise a shipping footprint according to said length 204 and said width 206.

Figure 7D:
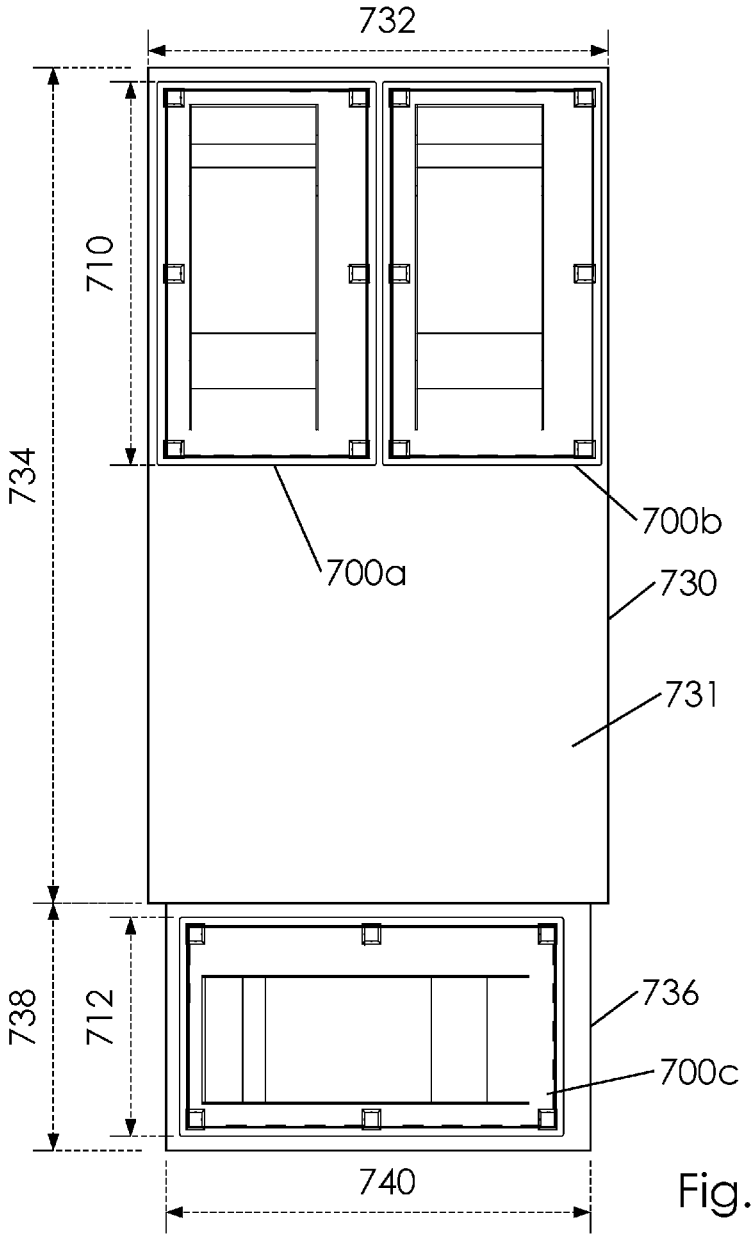
FIG. 7D illustrates an elevated top view of a plurality of packaged play systems in a shipping container.

FIG. 7D illustrates an elevated top view of a plurality of packaged play systems in a shipping container 730. In one embodiment, said shipping container 730 can comprise a shipping area 731 having a width 732 and a length 734. In one embodiment, said plurality of packaged play systems can comprise a first system 700*a*, a second system 700*b* and a third system 700*c*. In one embodiment, said shipping container 730 can hold one or more of said plurality of packaged play systems.

In one embodiment, said plurality of packaged play systems can be packaged up so as to minimize said shipping footprint (comprising said length 710 and said width 712) of each among said plurality of packaged play systems; wherein, a number of said plurality of packaged play systems can be maximized within said shipping area 731 of said shipping container 730. In one embodiment, said length 710 is less than said width 732 of said shipping container 730; and a number of said packaged play system 700 which can be fit into said shipping container 730 can be determined by dividing said width 712 into said length 734 of said shipping container 730. In one embodiment, said shipping container 730 can comprise a shipping container used in international shipping, train cargo, and/or truck trailers. Of course, a weight of said packaged play system 700 should be substantially identical to a weight of said assembled outdoor structure 100; this is remarkable and speaks to the lack of waste generated when building and shipping said packaged play system 700 with said flooring 102.

This new manner of shipping the structure also reduces the assembly time for the end user. Making it ideal for the "do it yourself shopper". It has been estimated that shipping said packaged play system 700 and will reduce the assembly time by 70-80%, which can reduce a 25-30 hour job to 2-3 hours. Use of said flooring 102 with said packaged play system 700 can also reduce the waste of a wooden pallet that someone would have to take to the landfill.

In one embodiment, said plurality of packaged play systems can further comprise a fourth system 700*d*, and said shipping container 730 can comprise a gate lift 736. In one embodiment, said gate lift 736 can comprise a length 738 greater than said width 712 of said packaged play system 700 and a width 740 greater than said length 710 of said packaged play system 700. In one embodiment, said width 740 can be less than or equal to said width 732. In one embodiment, by making said packaged play system 700 fit on said gate lift 736 it can be shipped more easily without special shipping equipment.

In one embodiment, said width 732 of said shipping container 730 can comprise 102", said width 712 of said packaged play system 700 can comprise 48"; wherein, said first system 700*a* and said second system 700*b* can fit side by side within said shipping container 730.

Figure 8A:
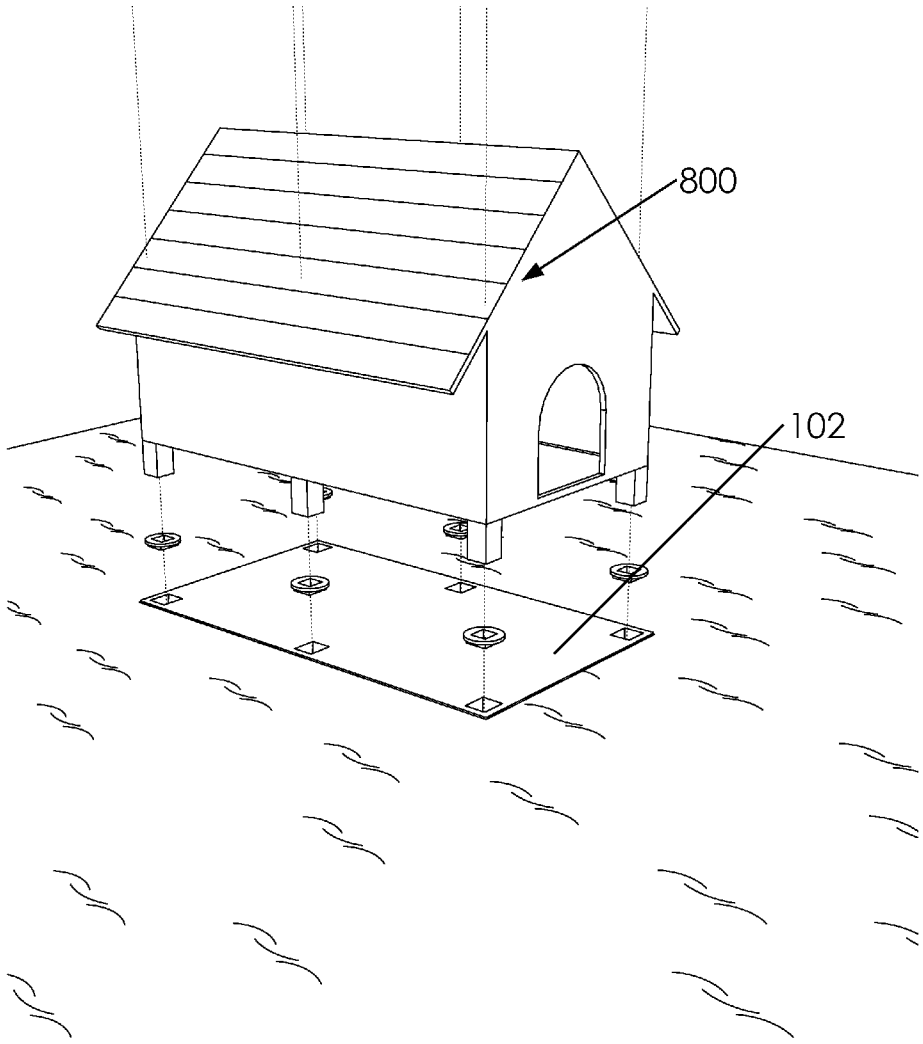
FIGS. 8A and 8B illustrate two front perspective views of different assembled types of structure systems such as a pet house and a storage structure.
Figure 8B:
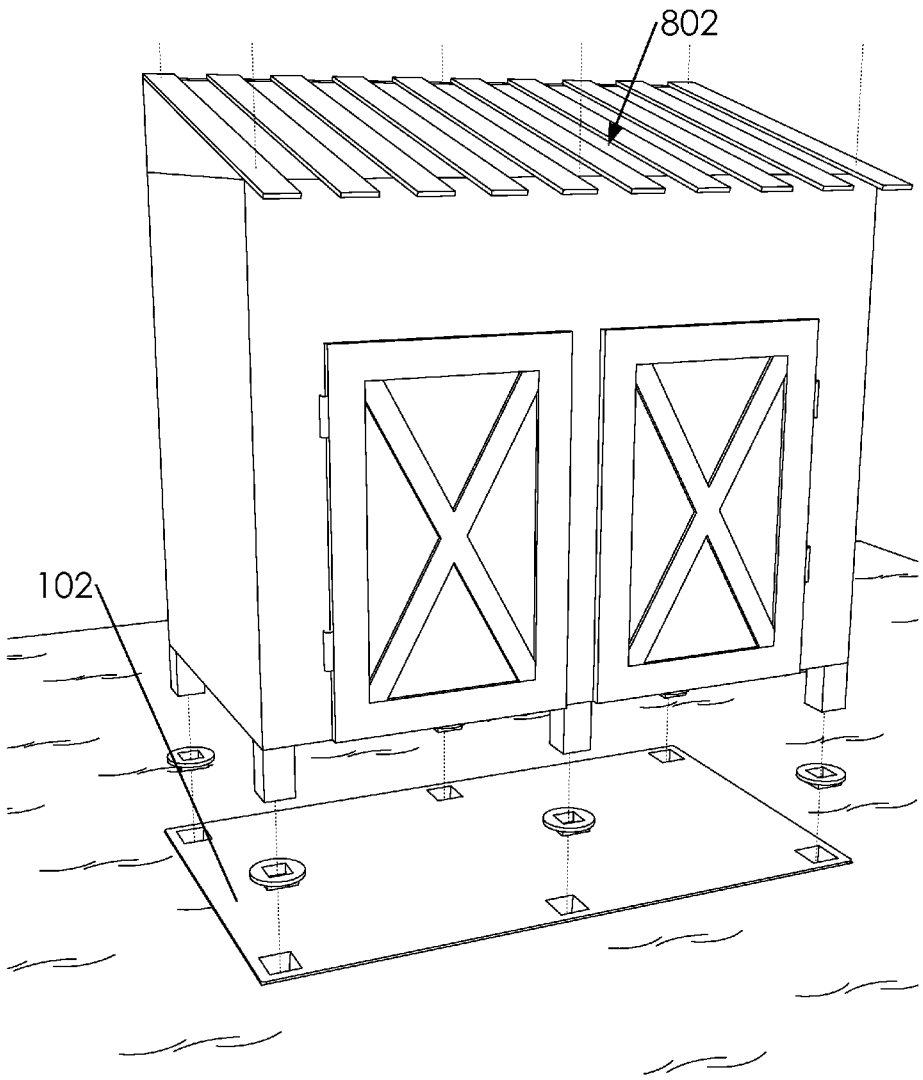

FIGS. 8A and 8B illustrate two front perspective views of different assembled types of structure systems such as a pet house 800 and a storage structure 802. In one embodiment, said pet house 800 and said storage structure 802 can comprise legs similar to said one or more legs of said assembled outdoor structure 100 that can be installed in said flooring 102. In one embodiment, said flooring 102 can serve as a shipping pallet for said pet house 800 and said storage structure 802. In one embodiment, said pet house 800 and storage structure 802 are examples and are not inclusive of structures that can be used.

Figure 9A:
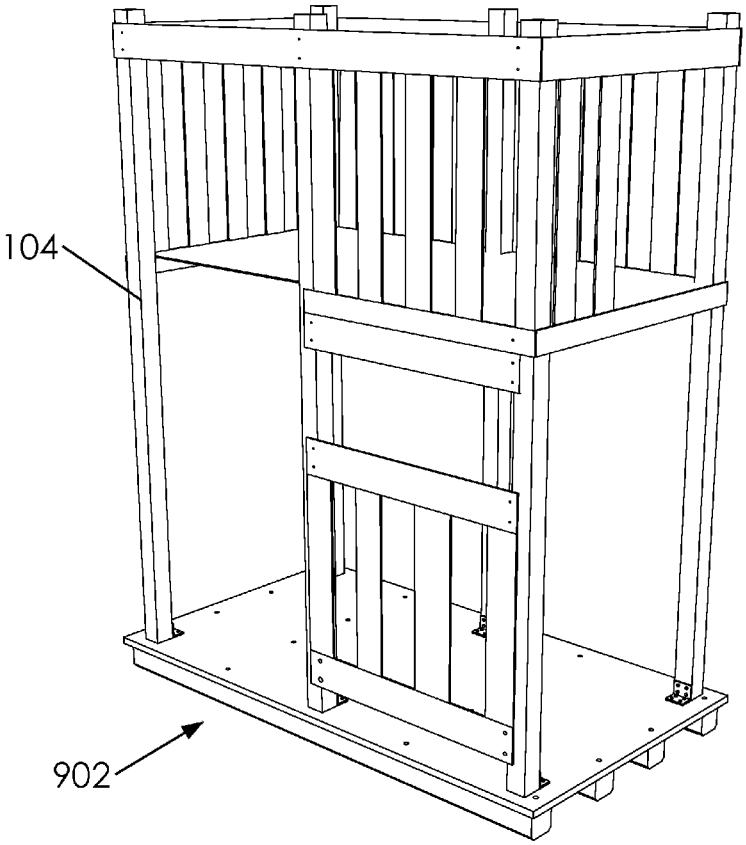
FIG. 9A illustrates a perspective overview of said outdoor structure and a socketless flooring.

FIG. 9A illustrates a perspective overview of said outdoor structure 104 and a socketless flooring 902. In one embodiment, said socketless flooring 902 can comprise a similar product to said flooring 102 without said one or more sockets.

Figure 9B:
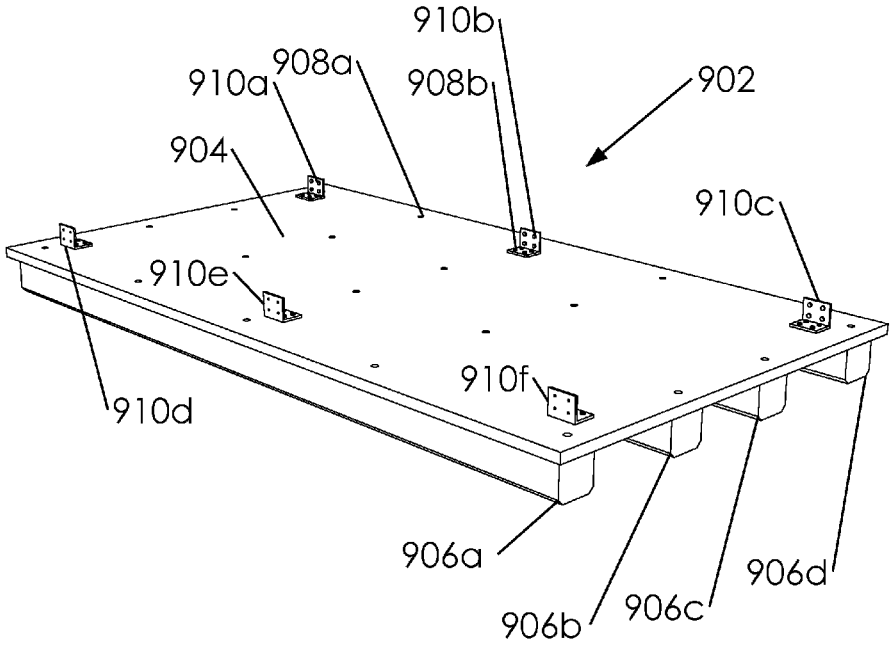
FIG. 9B illustrates a perspective overview of said socketless flooring.

FIG. 9B illustrates a perspective overview of said socketless flooring 902. In one embodiment, said socketless flooring 902 can comprise of a platform 904, a one or more support beams and a one or more brackets. In one embodiment, said one or more support beams can comprise a support beam 906*a*, a support beam 906*b*, a support beam 906*c*, and a support beam 906*d*. In one embodiment, said socketless flooring 902 can attach to said one or more support beams with a plurality of fasteners. In one embodiment, said plurality of fasteners can comprise a first fastener 908*a* and a second fastener 908*b*. In one embodiment, said one or more brackets can secure said outdoor structure 104 to said socketless flooring 902. In one embodiment, said one or more brackets can comprise a first bracket 910*a*, a second bracket 910*b*, a third bracket 910*c*, a fourth bracket 910*d*, a fifth bracket 910*e* and a sixth bracket 910*f*. In one embodiment, said one or more brackets can comprise "L" brackets. In one embodiment, said one or more brackets can attach to said platform 904 with one or more of said plurality of brackets fasteners (such as said second fastener 908*b*).

Figure 9C:
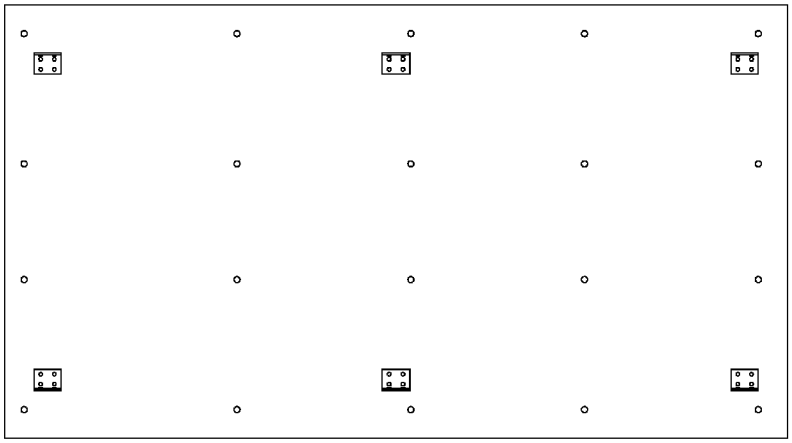
FIGS. 9C, 9D, and 9E illustrate an elevated top view, an elevated front view, and an elevated side view of said socketless flooring.
Figure 9D:
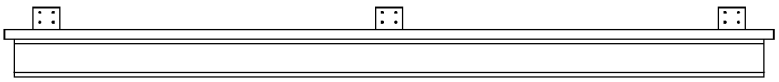
Figure 9E:
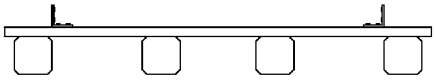

FIGS. 9C, 9D, and 9E illustrate an elevated top view, an elevated front view, and an elevated side view of said socketless flooring 902.

Figure 10A:
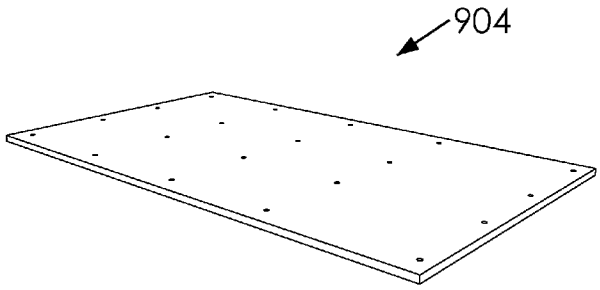
FIGS. 10A, 10B, and 10C illustrate a perspective overview, an elevated side view, and an elevated front view of said platform.
Figure 10B:
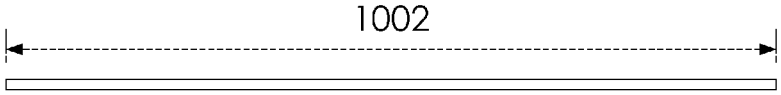
Figure 10C:
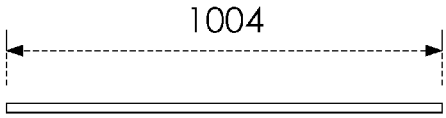

FIGS. 10A, 10B, and 10C illustrate a perspective overview, an elevated side view, and an elevated front view of said platform 904. In one embodiment, said platform 904 can comprise of a length 1002 and a width 1004.

Figure 11A:
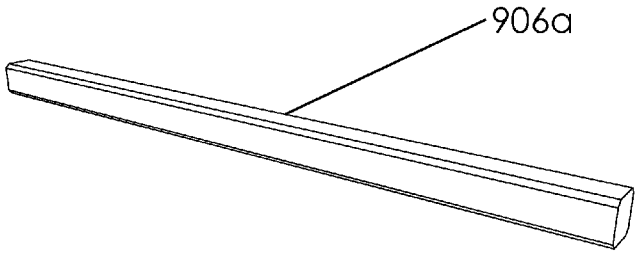
FIGS. 11A, 11B, and 11C illustrate a perspective overview, an elevated side view, and an elevated front view of said support beam.
Figure 11B:
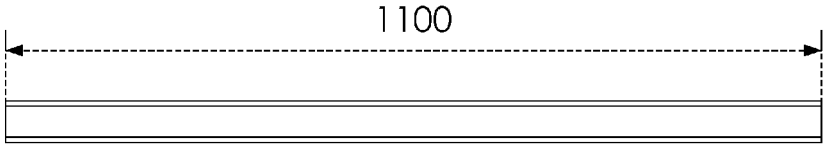
Figure 11C:
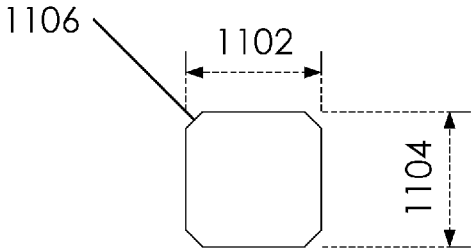

FIGS. 11A, 11B, and 11C illustrate a perspective overview, an elevated side view, and an elevated front view of said support beam 906*a*. In one embodiment, said support beam 906*a* can comprise of a length 1100, a width 1102, a height 1104, and a bevel 1106. In one embodiment, said one or more support beams can all be substantially similar to said support beam 906*a*, as illustrated.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An outdoor structure flooring apparatus comprising:

a flooring having a one or more sockets, a length and a width;

said one or more sockets receiving a portion of a one or more legs of an outdoor structure;

said flooring comprises a shipping pallet for said outdoor structure;

said one or more sockets and said one or more legs comprise of 6 of each;

said one or more sockets and said one or more legs are arranged around a perimeter of said flooring;

said one or more sockets comprise a top portion and a bottom portion;

said one or more sockets taper from said top portion to said bottom portion;

said outdoor structure comprises a one or more components;

said flooring and said outdoor structure comprises a packaged configuration and an assembled configuration;

said assembled configuration comprises said one or more components of said outdoor structure assembled for use;

said packaged configuration comprises said one or more components of said outdoor structure packaged for shipping;

said outdoor structure can comprise a play set;

said one or more components comprise a slide;

said packaged configuration of said outdoor structure can comprise said slide detached from a side portion of said outdoor structure and stored within a portion of said outdoor structure;

said flooring comprises a shipping pallet for said outdoor structure in said packaged configuration;

said assembled configuration comprises said slide attached to said side portion of said outdoor structure; and said flooring comprise a flooring for said outdoor structure m said assembled configuration.

2. An outdoor structure flooring apparatus comprising:

a flooring having a one or more sockets, a length and a width;

said one or more sockets receiving a portion of a one or more legs of an outdoor structure;

said flooring comprises a shipping pallet for said outdoor structure;

said one or more sockets comprise a top portion and a bottom portion; and said one or more sockets taper from said top portion to said bottom portion.

3. The outdoor structure flooring apparatus of claim 2 wherein said one or more sockets comprise at least four sockets;

said one or more legs comprise at least four legs;

said one or more sockets and one or more legs are at a four comers of said flooring; and said one or more legs hold down said flooring against a ground.

4. The outdoor structure flooring apparatus of claim 3 wherein:

said one or more sockets and said one or more legs comprise of 6 of each; and said one or more sockets and said one or more legs are arranged around a perimeter of said flooring.

5. The outdoor structure flooring apparatus of claim 2 wherein:

said one or more sockets comprise a stiffener assembly; and, said stiffener assembly supports a lower portion of said one or more legs.

6. The outdoor structure flooring apparatus of claim 5 wherein:

said bottom portion of said one or more sockets comprise a one or more drains;

said one or more drains are capable of allowing a fluid drainage through said one or more sockets; and said lower portion of said one or more legs are held above said one or more drains by said stiffener assembly.

7. The outdoor structure flooring apparatus of claim 2 wherein:

said outdoor structure comprises a one or more components;

said flooring and said outdoor structure comprises a packaged configuration and an assembled configuration;

said assembled configuration comprises said one or more components of said outdoor structure assembled for use; and said packaged configuration comprises said one or more components of said outdoor structure packaged for shipping.

8. The outdoor structure flooring apparatus of claim 7 wherein:

said outdoor structure can comprise a play set;

said one or more components comprise a slide;

said packaged configuration of said outdoor structure can comprise said slide detached from a side portion of said outdoor structure and stored within a portion of said outdoor structure; and said flooring comprises a shipping pallet for said outdoor structure in said packaged configuration.

9. The outdoor structure flooring apparatus of claim 7 wherein:

said outdoor structure can comprise a play set;

said one or more components comprise a slide;

said assembled configuration comprises said slide attached to a side portion of said outdoor structure; and said flooring comprise a flooring for said outdoor structure m said assembled configuration.

10. The outdoor structure flooring apparatus of claim 2 further comprising a one or more caps around said one or more legs coving a portion of said one or more sockets.

11. The outdoor structure flooring apparatus of claim 2 wherein:

said outdoor structure comprises a domesticated animal house.

12. The outdoor structure flooring apparatus of claim 2 wherein:

said flooring and said outdoor structure comprises a dog house when assembled.

13. The outdoor structure flooring apparatus of claim 2 wherein:

said flooring and said outdoor structure comprises a storage structure when assembled.

14. An outdoor structure installation method comprising:

assembling a one or more legs of an outdoor structure to a one or more sockets of an flooring;

receiving a portion of said one or more legs of said outdoor structure into said one or more sockets;

packing said flooring and said outdoor structure into a packaged configuration;

shipping said packaged configuration to a destination;

placing said outdoor structure and said flooring at said destination;

unpacking said packaged configuration to an assembled configuration; and wherein said flooring comprises a shipping pallet for said outdoor structure, said one or more sockets comprise a top portion and a bottom portion, and said one or more sockets taper from said top portion to said bottom portion.

15. The outdoor structure installation method of claim 14 wherein packing said flooring and said outdoor structure into a packaged configuration comprises:

storing a one or more components of said outdoor structure within a portion of said outdoor structure; wherein, said one or more components comprise a slide.

16. The outdoor structure installation method of claim 14 wherein unpacking said packaged configuration to an assembled configuration comprises:

removing a one or more components from within said outdoor structure in said packaged configuration, and installing said one or more components onto said outdoor structure in said assembled configuration; and wherein, said one or more components comprise a slide, and said assembled configuration comprises said slide attached to a side portion of said outdoor structure.

17. The outdoor structure installation method of claim 14 wherein shipping said packaged configuration to a destination comprises shipping a plurality of said packaged configuration of said outdoor structure together in a shipping container; wherein, said plurality of said packaged configuration of said outdoor structure comprise a length and a width equal to a length and a width of said flooring.

18. An outdoor structure flooring apparatus comprising:

a socketless flooring having a length and a width and a one or more brackets;

said socketless flooring comprising a platform and a one or more support beams;

said one or more brackets attach a one or more legs of an outdoor structure to said platform;

said flooring comprises a shipping pallet for said outdoor structure;

said outdoor structure comprises a one or more components;

said socketless flooring and said outdoor structure comprises a packaged configuration and an assembled configuration;

said assembled configuration comprises said one or more components of said outdoor structure assembled for use;

said packaged configuration comprises said one or more components of said outdoor structure packaged for shipping;

said packaged configuration of said outdoor structure can comprise said one or more components detached from a side portion of said outdoor structure and stored within a portion of said outdoor structure;

said flooring comprises a shipping pallet for said outdoor structure in said packaged configuration;

said assembled configuration comprises said one or more components attached to a portion of said outdoor structure; and said flooring comprise a flooring for said outdoor structure m said assembled configuration;

said outdoor structure can comprise a play set;

said one or more components comprise a slide;

said packaged configuration of said outdoor structure can comprise said slide detached from said side portion of said outdoor structure and stored within a portion of said outdoor structure; and said flooring comprises a shipping pallet for said outdoor structure in said packaged configuration.

19. The outdoor structure flooring apparatus of claim 18 wherein:

said outdoor structure can comprise a play set;

said one or more components comprise a slide; and said assembled configuration comprises said slide attached to said side portion of said outdoor structure.

* * * * *